United States Patent [19]

Komada et al.

[11] Patent Number: 4,537,491

[45] Date of Patent: Aug. 27, 1985

[54] DEVELOPMENT APPARATUS FOR DEVELOPING LATENT ELECTROSTATIC IMAGES

[75] Inventors: Kenya Komada, Yokohama; Kazuhiro Yuasa, Zama; Shiroh Kondoh, Sagamihara, all of Japan

[73] Assignee: Ricoh Company, Ltd., Tokyo, Japan

[21] Appl. No.: 434,005

[22] Filed: Oct. 13, 1982

[30] Foreign Application Priority Data

| | | | |
|---|---|---|---|
| Oct. 20, 1981 | [JP] | Japan | 56-167737 |
| Nov. 26, 1981 | [JP] | Japan | 56-189523 |
| Mar. 31, 1982 | [JP] | Japan | 57-50982 |

[51] Int. Cl.[3] ..... G03G 15/09

[52] U.S. Cl. ..... 355/3 DD; 118/658

[58] Field of Search ..... 355/3 DD, 3 BE, 3 R, 355/10, 16; 118/656, 657, 658; 430/122, 123

[56] References Cited

U.S. PATENT DOCUMENTS

| | | | |
|---|---|---|---|
| 4,320,958 | 3/1982 | Fantuzzo | 118/658 X |
| 4,324,490 | 4/1982 | Burnham | 118/657 X |
| 4,397,264 | 8/1983 | Hatch | 118/656 |
| 4,417,802 | 11/1983 | Forbes | 118/658 X |
| 4,444,864 | 4/1984 | Takahashi | 118/658 X |

*Primary Examiner*—R. L. Moses

*Attorney, Agent, or Firm*—Oblon, Fisher, Spivak, McClelland & Maier

[57] ABSTRACT

A development apparatus for developing latent electrostatic images to visible or transferable images of high quality for use in electrophotographic copying apparatus, electrostatic recording apparatus, facsimile apparatus or other recording apparatus, in which a development roller is in arc-contact with a latent-electrostatic-image-bearing flexible recording medium and is capable of supplying a sufficient amount of toner to the recording medium for development of the latent electrostatic images, without requiring any delicate adjustment of the gap between the development roller and the recording medium or of the gap between the development roller and a doctor blade for regulating the thickness of a toner layer on the development roller, and without increasing the rotary speed of the development roller to conventional speeds, and the doctor blade is also capable of performing charge injection to the toner with high efficiency, whereby images can be developed with high quality with a minimum deposition of toner on the background.

8 Claims, 7 Drawing Figures

DEVELOPMENT APPARATUS FOR DEVELOPING LATENT ELECTROSTATIC IMAGES

BACKGROUND OF THE INVENTION

The present invention relates to a development apparatus for developing latent electrostatic images to visible or transferable images of high quality for use in electrophotographic copying apparatus, electrostatic recording apparatus, facsimile apparatus or other recording apparatus. More particularly, the present invention relates to a development apparatus of the above described type in which a development roller is in arc-contact with a latent-electrostatic-image-bearing flexible recording medium and is capable of supplying a sufficient amount of toner to the recording medium for development of the latent electrostatic images, without requiring any delicate adjustment of the gap between the development roller and the recording medium or of the gap between the development roller and a doctor blade for regulating the thickness of a toner layer on the development roller, and without increasing the rotary speed of the development roller to conventional high speeds, and in which the doctor blade is also capable of performing charge injection to the toner with high efficiency, whereby images can be developed with high quality with a minimum of deposition of toner on the background.

In a conventional development apparatus for developing latent electrostatic images by toner for use in an electrophotographic or electrostatic image recording system, the toner is supplied to a latent-electrostatic-image-bearing recording medium by a development roller carrying a thin layer of the toner thereon, regulated to a predetermined thickness by a doctor blade, with a certain gap maintained accurately between the development roller and the recording medium. Usually, in such a development apparatus, it is necessary to maintain accurately the gap between the development roller and the recording medium so as to be slightly greater than the gap between the development roller and the doctor blade. Therefore, it is necessary that the members for maintaining those gaps and other relevant members be made with high assembly accuracy.

Furthermore, in the above-described conventional apparatus, the effective development area between the development roller and the latent-electrostatic-image-bearing recording medium, where latent electrostatic images are developed by toner being transferred from the development roller to the recording medium, is inevitably small due to the above-described gap between the development roller and the recording medium and the conventional shapes of the development roller and the recording medium (the recording medium is typically a cylindrical drum). When the development area is small, there is the risk that a sufficient amount of toner for development will not always be supplied to the recording medium. Accordingly, there is the risk that images of high quality will not always be obtained. Therefore, in a conventional development apparatus of the above-described type, in order to minimize the above risk, the development roller is rotated at speeds as high as 4 to 5 times the peripheral rotary speed of the recording medium in an effort to guarantee availability of sufficient toner.

Furthermore, in the case where latent electrostatic images formed on a recording medium are developed to visible images by use of a high-resistivity one-component-type magnetic toner, it is necessary that the quantity of electric charges in each toner particle be great in order to obtain developed images of high quality and still not cause toner deposition on the background thereof.

In particular, in the case of an image-transfer type recording system employing an electrostatic recording process using a dielectric recording medium, it is extremely difficult to quench charges on the recording medium before formation of latent electrostatic images. Therefore, the recording medium is uniformly pre-charged to a certain surface potential before latent electrostatic images are formed, and latent electrostatic images are then formed by applying voltages to the pre-charged recording medium so as to partially quench the former charges in the form of latent electrostatic images, by use of a multi-stylus head or the like.

In the above-mentioned type recording system, if the quantity of charges in each toner particle is insufficient, the toner is deposited markedly on the background, and, as a matter of course, the obtained image quality is significantly reduced. In order to eliminate such shortcomings, in a conventional development apparatus of the type employing a development roller comprising a rotatable non-magnetic, metallic, cylindrical sleeve for forming a magnetic brush thereon, with a stationary inner magnetic roller therein, voltage is applied to the surface of a layer of magnetic toner on the non-magnetic sleeve so as to electrically charge the magnetic toner. However, by that method, the toner cannot be electrically charged sufficiently for obtaining high image quality with avoidance of deposition of the toner on the background.

SUMMARY OF THE INVENTION

It is therefore a primary object of the present invention to provide an improved development apparatus for developing latent electrostatic images to visible or transferable images of high image quality, with a minimum of deposition of toner on the background, for use in electrophotographic copying apparatus, electrostatic recording apparatus, facsimile apparatus and other recording apparatus, which development apparatus is of the type in which a development roller is in arc-contact with a latent-electrostatic-image-bearing flexible recording medium and is capable of supplying a sufficient amount of toner to the recording medium for development of the latent electrostatic images, without requiring any delicate adjustment of the gap between the development roller and the recording medium or of the gap between the development roller and a doctor blade for regulating the thickness of a toner layer on the development roller, and without increasing the rotary speed of the development roller to the conventional 4 to 5 times the peripheral rotary speed of the recording medium.

Another object of the present invention is to provide a development apparatus of the above-described type in which a development roller comprises (1) a rotary sleeve with an inner magnet, which rotary sleeve is in arc-contact with the latent-electrostatic-image-bearing flexible recording medium, and, is, if necessary, covered with an electroconductive rubber layer, and (2) a doctor blade for regulating the thickness of a layer of the toner on the development roller and capable of performing charge injection to the toner with high efficiency.

According to the present invention, developed images of high image quality with a minimum of deposition of toner on the background can be obtained by a development apparatus with the above-described improvements.

DETAILED DESCRIPTION OF THE PREFERRED EMBODIMENTS

Figure 1:
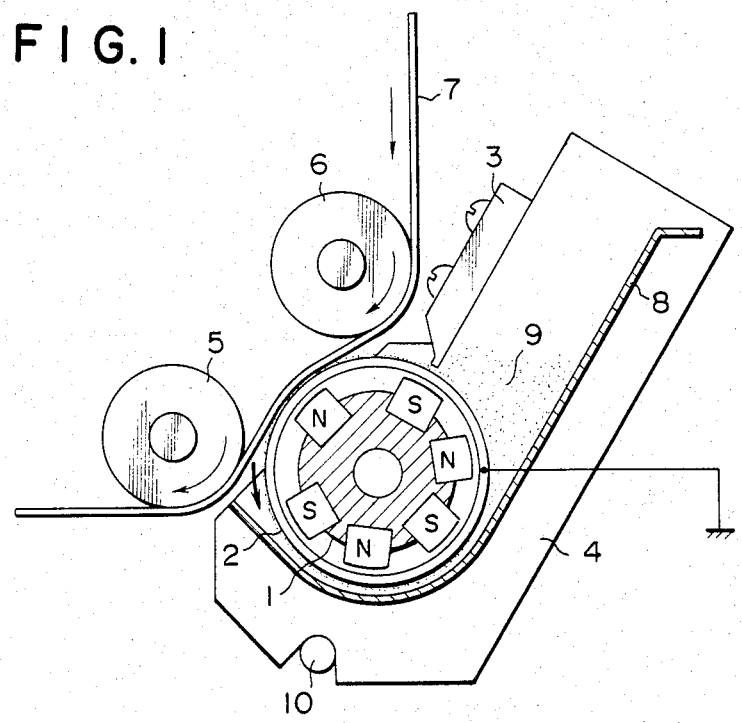
FIG. 1 is a schematic cross-sectional view of an embodiment of a development apparatus according to the present invention.

Referring to FIG. 1, there is shown a schematic cross-sectional view of an embodiment of a development apparatus according to the present invention.

In the figure, reference numeral 1 represents a stationary (or rotatably driven) magnetic roller with a plurality of magnetic poles, magnetized so as to form a uniform magnetic field in the axial direction of the magnetic roller. Around the magnetic roller 1, there is disposed a rotatably driven (or stationary), non-magnetic, cylindrical sleeve 2 made of a metallic pipe. The thus arranged magnetic roller 1 and non-magnetic sleeve 2 constitute a development roller.

A doctor blade 3 is disposed in such a manner that one end portion thereof is fixed to a casing 4 of the development apparatus and the other end thereof is positioned at a predetermined distance from the outer peripheral surface of the non-magnetic sleeve 2.

An endless-belt-shaped recording medium 7, made of a photoconductive film or a dielectric film, is disposed so as to be in arc-contact with part of the peripheral surface of the non-magnetic sleeve 2 of the development roller, and is transported in the direction of the arrow by a pair of guide rollers 5 and 6 with appropriate tension applied thereto by the development roller and by the guide rollers 5 and 6.

The non-magnetic sleeve 2 is grounded so as to be at the same electric potential as the electric potential of an electroconductive layer of the recording medium 7.

In the figure, reference numeral 8 represents a container of a magnetic toner 9; and reference numeral 10, a pivot for attachment of the development apparatus.

In the thus constructed embodiment of a development apparatus according to the present invention, a thin layer of the magnetic toner 9 is formed on the non-magnetic sleeve 2, regulated to a predetermined thickness by the doctor blade 3, and is supplied to the recording medium 7 which bears latent electrostatic images thereon, as either the non-magnetic sleeve 2 or the magnetic roller 1 is driven in rotation, whereby the latent electrostatic images are developed by the magnetic toner 9.

As mentioned previously, in this embodiment, since the non-magnetic sleeve 2 of the development roller is in arc-contact with the recording medium 7, a development area between the development roller and the recording medium 7, in which the magnetic toner 9 is transferred from the development roller to the recording medium 7, for development of the latent electrostatic images, is relatively large, so that the magnetic toner 9 is supplied sufficiently to the recording medium 7, and the latent electrostatic images are developed with high image quality and with a minimum of toner deposition on the background.

When viewed in cross section, as in FIG. 1, the size of such a development area between the recording medium 7 and the development roller (the magnetic roller 1 together with the non-magnetic sleeve 2) is the length of the recording medium 7 (extending into the drawing) times the width of the contact area (the length of the arc of contact). That arc-shaped width of the contact is hereinafter referred to as the "nip width," and is a function of the depth of the depression formed in the recording medium 7 by the development roller.

For instance, in a conventional development apparatus in which a latent-electrostatic-image-bearing rigid photoconductor drum is substantially in line-contact with a development roller, the development area is extremely small and the nip width is nearly zero, while, in the present invention, the nip width is large and the development area is accordingly large. Obviously, the larger the nip width, the greater the amount of the toner supplied from the development roller to the recording medium 7, all else being the same.

In the above-described development apparatus, since the nip width is considerably greater than that in a conventional development apparatus comprising a rigid drum-shaped recording medium, it is unnecessary to rotate the development roller at conventional speeds as high as 4 to 5 times the peripheral rotary speed of the recording medium 7. Instead, the rotary speed of the development roller can be held to only about 1 to 3 times, preferably 1.5 to 2.5 times, the peripheral rotary speed of the recording medium 7, at which reduced rotary speeds of the development roller, development of latent electrostatic images can be done successfully.

Furthermore, in the above-described embodiment of a development apparatus according to the present invention, since the development roller is in arc-contact with the flexible recording medium 7, the tolerable range of the nip width for use in practice is rather large. As a result, unlike the above-mentioned conventional development apparatus, delicate adjustment of the gap between the recording medium 7 and the development roller is unnecessary, and relatively rough adjustment of the gap between the doctor blade 3 and the development roller is all that is required.

In the case of a conventional image recording system in which the surface of the recording medium 7 is uniformly charged or image transfer is performed by a corona charger, the surface of the recording medium 7 is apt to be oxidized by a layer of ozone formed on the surface of the recording medium 7 during corona discharging. As a result, there is a tendency for the recording capability of the recording medium 7 to significantly deteriorate, sometimes in a rather short period of time.

According to the present invention, however, by the arc-contact of the development roller with the recording medium 7 with a comparatively great nip width, the formation of a layer of ozone is effectively prevented, so that the life of the recording medium 7 can be significantly increased.

Figure 2:
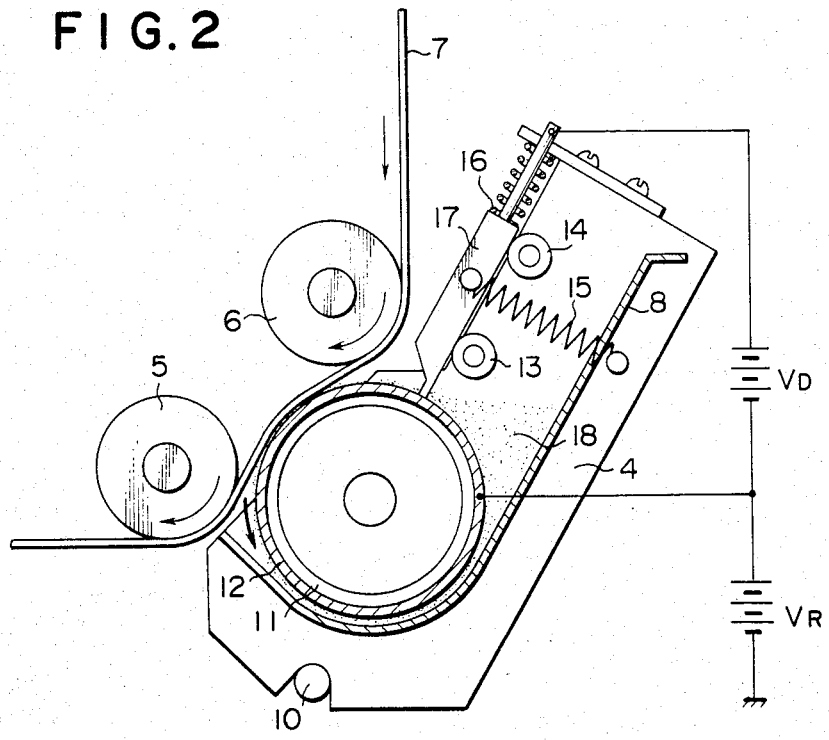
FIG. 2 is a schematic cross-sectional view of another embodiment of a development apparatus according to the present invention.

Referring to FIG. 2, there is shown a schematic cross-sectional view of another embodiment of a development apparatus according to the present invention. In the figure, the members and apparatus which are substantially the same in function as those shown in FIG. 1 bear the same reference numerals. The same thing applies to the other accompanying figures.

In FIG. 2, a development roller comprises a metallic pipe 11 which is covered by an electroconductive rubber layer 12, and is driven in rotation during development of latent electrostatic images.

The electroconductive rubber layer 12 can be made of silicone rubber, chloroprene rubber or polyurethane rubber, with a specific resistivity ranging from $10^3$ ohm·cm to $10^8$ ohm·cm and with a thickness ranging from 0.5 mm to 5 mm.

A doctor blade 17 is disposed so as to be in sliding contact with a pair of guide rollers 13 and 14 disposed at a side plate of the casing 4, the doctor blade 17 held against the rollers 13 and 14 by a spring member 15 in such a manner that a top of the doctor blade 17 is in light contact with the electroconductive rubber layer 12, with the doctor blade 17 urged inward against the development roller by a spring member 16 as shown in FIG. 2. By this structure, changes in position of the doctor blade 17 which may be caused by its contact with the electroconductive rubber layer 12 are most effectively minimized, so that uniform charge injection and formation of a thin layer of the toner with a uniform thickness can be guaranteed.

To the metallic pipe 11 (or the electroconductive rubber layer 12), there is applied a bias voltage $V_R$ (in the case of direct development, the metallic pipe 11 can be grounded so as to be at an earth potential) and a bias voltage $V_D$ is also applied between the doctor blade 17 and the metallic pipe 11 (or the electroconductive rubber layer 12) (in the case of direct development, the setting of the polarity of the bias voltage $V_D$ shown in FIG. 2 has to be reversed).

In the thus constructed development apparatus, a thin layer of a toner 18 (which is not necessarily a magnetic toner) is uniformly formed on the development roller by the doctor blade 17.

When the toner 18 is carried on the electroconductive layer 12 by the friction between the toner 18 and the electroconductive layer 12, as well as by the triboelectric charges generated between the toner 18 and the electroconductive layer 12, as the metallic pipe 11 is driven in rotation, charge injection into the toner 18 is directly done by the doctor blade 17, so that the toner 18 is electrically charged uniformly to a potential sufficient for avoidance of deposition of the toner on the background. The thus charge-injected toner 18 is then supplied to the surface of the recording medium 7.

When the toner 18 that has been electrically charged in the above-described manner and formed into a thin layer by the doctor blade 17 is carried to the surface of the recording medium 7, latent electrostatic images on the recording medium 7 are subjected to reverse development by the toner 18 on the surface of the development roller which is electrically charged to a pre-charge potential. As a matter of course, the charging polarity of the toner 18 is the same as the charging polarity of the background potential of the recording medium 7, which is also the same as the above-mentioned pre-charge potential.

Since the toner 18 supplied to the recording medium 7 has been uniformly charged by the doctor blade 17, the polarity and the charge quantity of the toner particles are uniform, so that the chances of the toner particles being deposited on the background, or of being randomly air-borne, are minimized.

In the above apparatus, since the development potential is the sum of the bias voltage $V_R$ and the injected charge potential of the toner 18, the developed images have high image density.

In the case of reversal development, the polarities of the bias voltages $V_D$ and $V_R$ are the same as the background potential of the recording medium 7. In contrast, in the case of normal development, the bias voltage $V_R$ can be at an earth (zero) potential, which is the same as the potential of an electroconductive layer of the recording medium 7, while the bias voltage $V_D$ is opposite in polarity to the image potential of the recording medium 7.

Figure 3:
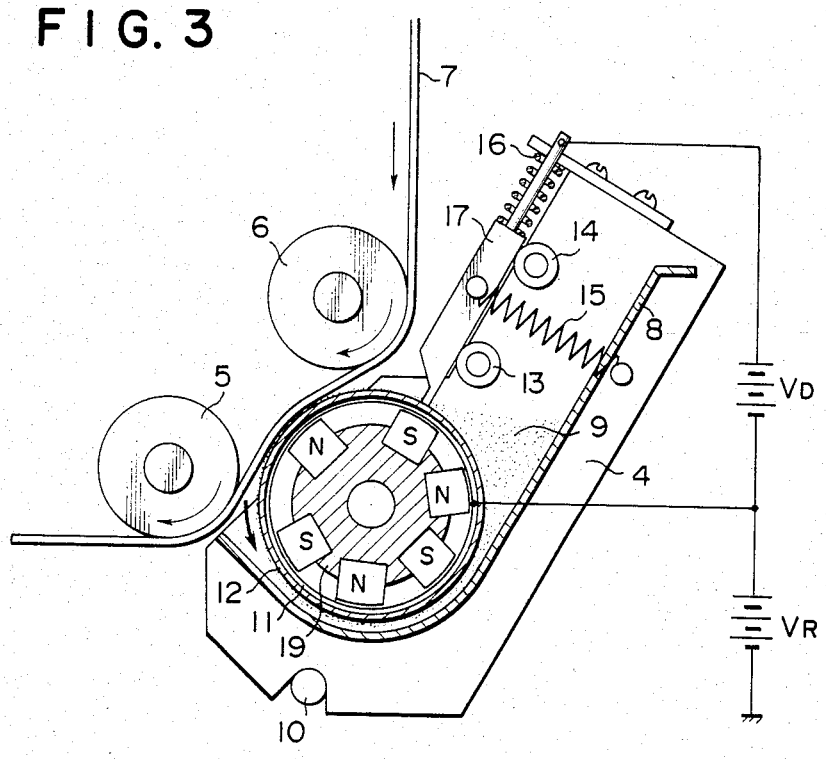
FIG. 3 is a schematic cross-sectional view of a further embodiment of a development apparatus according to the present invention.

Referring to FIG. 3, there is shown a schematic cross-sectional view of a further embodiment of a development apparatus according to the present invention.

In this embodiment, there is disposed within the metallic pipe 11 a stationary magnetic roller 19 with a plurality of magnetic poles, magnetized so as to be capable of forming a uniform magnetic field in the axial direction thereof. The metallic pipe 11 is covered by the electroconductive rubber layer 12 and is driven in rotation in the direction of the arrow.

The doctor blade 17 is the same as that shown in FIG. 2. Specifically, it is disposed so as to be in sliding contact with a pair of guide rollers 13 and 14 disposed at a side plate of the casing 4 of the development apparatus by a spring member 15, in such a manner that a top end of the doctor blade 17 is in light contact with the electroconductive rubber layer 12, with the doctor blade 17 urged inward toward the development roller by a spring member 16 as shown in FIG. 2.

By this structure, changes in position of the doctor blade 17 which may be caused by its contact with the electroconductive rubber layer 12 are most effectively minimized, so that uniform charge injection and formation of a thin layer of the toner with a uniform thickness can be guaranteed.

To the metallic pipe 11, there is applied a bias voltage $V_R$, and a bias voltage $V_D$ is also applied between the doctor blade 17 and the metallic pipe 11, so that the magnetic toner 9, which has been electrically charged by the doctor blade 17, is transported to the recording medium 7 smoothly.

Figure 4:
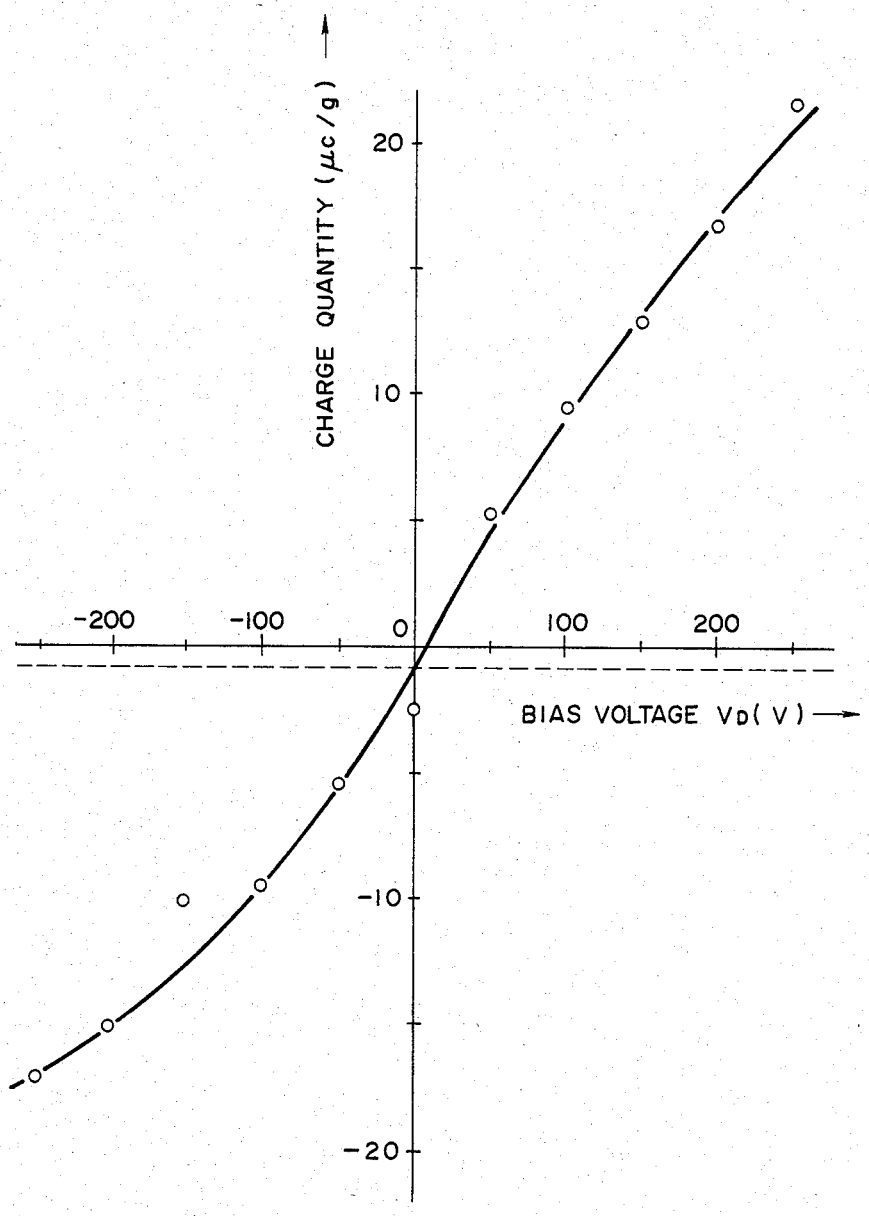
FIG. 4 is a graph showing the charging characteristics of a magnetic toner which is electrically charged by charge injection by a development apparatus according to the present invention.

Referring to FIG. 4, there is shown a graph showing the charging characteristics of a magnetic toner which can be electrically charged by charge injection by the above-described development apparatus according to the present invention.

In general, the greater the bias voltage $V_D$ or the greater the resistivity of the magnetic toner, the greater the quantity of electric charges that the magnetic toner accepts by charge injection. Furthermore, since the magnetic poles in each toner particle are not always well balanced in position, the charge-quantity curve does not always pass through the origin of the charge quantity - bias voltage coordinate axes as shown in FIG. 4.

Also, the thinner the layer of the toner which passes between the doctor blade 17 and the peripheral surface of the development roller (refer to FIGS. 2 and 3), the higher the charge injection efficiency, since the thinner the layer of the toner, the greater the chances of each toner particle coming into contact with the doctor blade 17.

When the magnetic toner employed in the present invention contains iron powder, it is preferable that the iron powder be of small particle size and be well dispersed within the toner particles, in order to increase the charge-injection efficiency by avoidance of the electroconductive rubber layer 12 and the doctor blade 17 becoming short-circuited through the toner particles.

Figure 5:
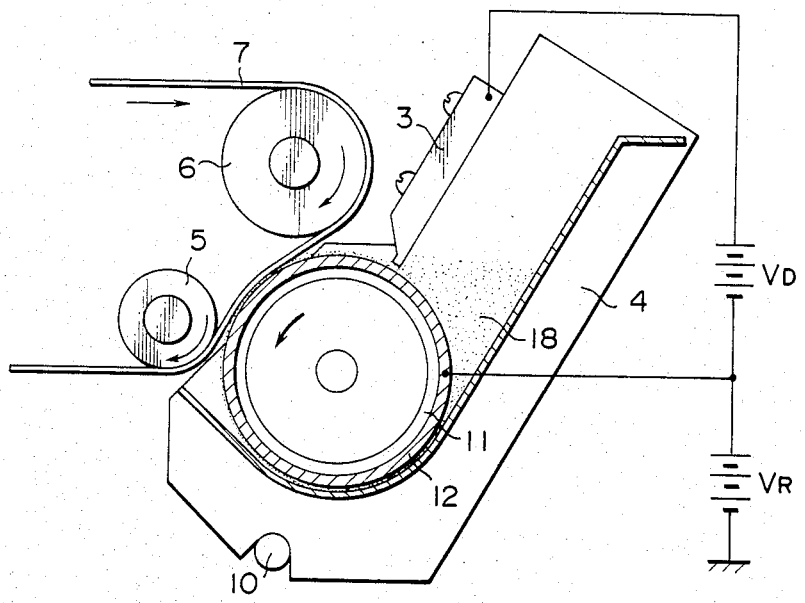
FIG. 5 is a schematic cross-sectional view of still another embodiment of a development apparatus according to the present invention.

Referring to FIG. 5, there is shown a schematic cross-sectional view of still another embodiment of a development apparatus according to the present invention.

As shown in the figure, the development roller is the same as that shown in FIG. 2, comprising the metallic pipe 11 which is covered with the electroconductive rubber layer 12 and is driven in rotation during development of latent electrostatic images. The doctor blade 3 is the same as that shown in FIG. 1, that is, one end thereof is fixed to the casing 4 of the development apparatus, and the other end thereof is positioned at a predetermined distance from the outer peripheral surface of the electroconductive rubber layer 12. To the electroconductive rubber layer 12, there is applied a bias voltage $V_R$, and a bias voltage $V_D$ is also applied between the doctor blade 3 and the electroconductive rubber layer 12.

In this structure, since the gap between the electroconductive rubber layer 12 and the end of the doctor blade 3 must be maintained accurately, it is required that the relevant parts have high assembly accuracy. However, since the doctor blade 3 is out of contact with the electroconductive rubber layer 12, the electroconductive rubber layer 12 can be used for a prolonged period of time, as compared with the case where the doctor blade is in contact with the electroconductive rubber layer 12.

Figure 6:
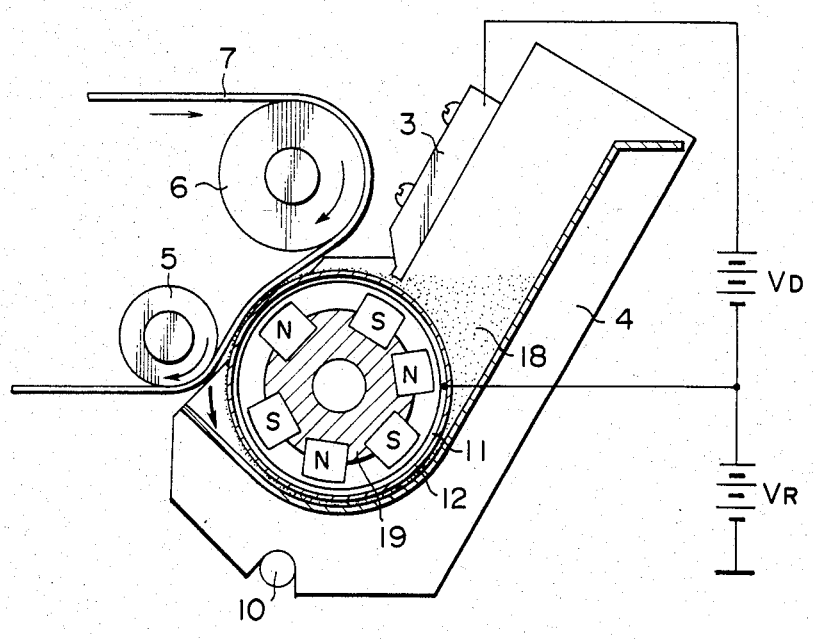
FIG. 6 is a schematic cross-sectional view of a still further embodiment of a development apparatus according to the present invention.

Referring to FIG. 6, there is shown a schematic cross-sectional view of a still further embodiment of a development apparatus according to the present invention.

As shown in the figure, the development roller is the same as that shown in FIG. 3, comprising the rotatable metallic pipe 11 with the stationary inner magnetic roller 19 with a plurality of magnetic poles, magnetized so as to be capable of forming a uniform magnetic field in the axial direction thereof. The metallic pipe 11 is covered by the electroconductive rubber layer 12 and is driven in rotation in the direction of the arrow. The doctor blade 3 is the same as that shown in FIG. 3, that is, one end thereof is fixed to the casing 4 of the development apparatus, and the other end thereof is positioned at a predetermined distance from the outer peripheral surface of the electroconductive rubber layer 12. To the electroconductive rubber layer 12, there is applied a bias voltage $V_R$, and a bias voltage $V_D$ is also applied between the doctor blade 3 and the electroconductive rubber layer 12.

Figure 7:
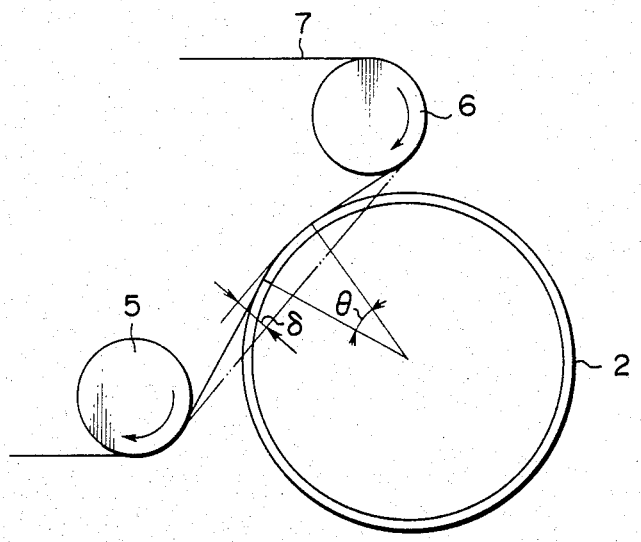
FIG. 7 is a schematic illustration in explanation of the relative arrangement of a latent-electrostatic-image-bearing recording medium and a development roller in the above embodiments of a development apparatus according to the present invention.

Referring to FIG. 7, there is shown a schematic illustration in explanation of the relative arrangement of a latent-electrostatic-image-bearing recording medium and a development roller in the above embodiments of a development apparatus according to the present invention.

As shown in the figure, the endless-belt-type latent-electrostatic-image-bearing electrostatic-image-bearing recording medium 7 is trained over the guide rollers 5 and 6 and other guide rollers (not shown) and is in arc-contact with the surface of the development sleeve 2 (which can be covered by an electroconductive recording layer as explained previously), with appropriate tension applied thereto by that arc-contact, at a portion of the recording medium 7 between the two guide rollers 5 and 6. In the figure, the guide roller 6 also serves as a drive roller rotated in the direction of the arrow, while the guide roller 5 simply serves as a free guide roller.

In the present invention, it is preferable that the distance $\delta$ between (1) a common tangent to the two guide rollers 5 and 6, corresponding to the position of the recording medium 7 when stretched tightly between the two guide rollers 5 and 6, out of contact with the development sleeve 2 (indicated by the alternate long and two short dashes line in the figure) and (2) a tangent to the development sleeve 2 at an arc-contact point parallel to the above common tangent, be in the range of 0.3 mm to 1.0 mm, preferably in the range of 0.3 mm to 0.6 mm, when the diameter of the development sleeve 2 is about 38 mm. In terms of the arc-contact angle, which is defined as the central angle corresponding to the arc of the development roller in contact with the recording medium 7, as indicated by $\theta$, it is preferable that the angle $\theta$ be in the range of 3° to 11° in the above-mentioned case.

In the configuration shown in FIG. 7, since the guide roller 6 is driven in the direction of the arrow and serves to forcibly transport the recording medium 7, more tension exists in the recording medium 7, by virtue of that arrangement alone, on the upstream side than on the downstream side of the guide roller 6. Moreover, since in respect of only the multiple guide rollers (shown and not shown), some slack remains in the recording medium 7 as it is trained over those guide rollers, it is possible for the development sleeve 2 to be disposed in arc-contact with the recording medium 7, forming the aforementioned depression therein, without creating excess tension or excess contact pressure between the recording medium 7 and the development sleeve 2. As a result of the contact pressure thus being so small, the conventional risk that contact pressure between a recording medium and a development roller will deform the layer of toner in the contact area can also be eliminated. Yet, even with such low pressure, development can be performed efficiently since the arc-contact area is comparatively large.

A further reason for it being preferable that the guide roller 6, which serves as a drive roller, be situated above the development sleeve 2, while the guide roller 5 is positioned beside the development sleeve 2 as shown in FIG. 7, is as follows: When the less stretched portion of the recording medium 7 comes into arc-contact with the development sleeve 2, the weight and flexibility of the recording medium 7 itself also serves to attain a slightly more appropriate contact of the recording medium 7 with the development sleeve 2, in terms of complete contact and for avoidance of any adverse effects of the contact pressure on the toner layer.

What is claimed is:

1. In a development apparatus for developing latent electrostatic images borne by a belt-shaped flexible recording medium to visible or transferable images by a rotatable development roller which carries toner thereon and supplies the toner to said recording medium for developing the latent electrostatic images, the improvement wherein said development roller comprises a non-magnetic, cylindrical sleeve and a magnetic roller disposed within said non-magnetic cylindrical sleeve, said non-magnetic cylindrical sleeve and said magnetic roller each capable of being driven in rotation relative to the other, the ratio of the peripheral rotary speed of said non-magnetic cylindrical sleeve or said magnetic roller to the peripheral rotary speed of said recording medium is in the range of 1.5 to 2.5, said toner carried on said development roller is regulated to a predetermined thickness by a doctor blade, and said belt-shaped flexible recording medium is in arc-contact with said development roller.

2. In a development apparatus for developing latent electrostatic images borne by a belt-shaped flexible recording medium to visible or transferable images by a rotatable development roller which carries toner thereon and supplies the toner to said recording meidum for developing the latent electrostatic images, the improvement wherein said development roller comprises a non-magnetic, cylindrical sleeve which is covered with an electroconductive layer, a magnetic roller disposed within said non-magnetic cylindrical sleeve, said non-magnetic cylindrical sleeve and said magnetic roller each capable of being driven in rotation relative to the other, the ratio of the peripheral rotary speed of said non-magnetic cylindrical sleeve or said magnetic roller to the peripheral rotary speed of said recording medium is in the range of 1.5 to 2.5, said toner carried on said development roller is regulated to a predetermined thickness by a doctor blade, and said belt-shaped flexible recording medium is in arc-contact with said development roller.

3. In a development apparatus for developing latent electrostatic images borne by a belt-shaped flexible recording medium to visible or transferable images by a rotatable development roller which carries toner thereon and supplies the toner to said recording medium for developing the latent electrostatic images, the improvement wherein said development roller comprises a non-magnetic cylindrical sleeve which is covered with an electroconductive layer, said toner carried on said development roller is regulated to a predetermined thickness by a doctor blade, said belt-shaped flexible recording medium is in arc-contact with said development roller, said doctor blade is in light contact with the surface of said electroconductive layer, a bias voltage is applied to said non-magnetic cylindrical sleeve or to said electroconductive layer, and another bias voltage is applied between said doctor blade and said non-magnetic cylindrical sleeve or said electroconductive rubber layer.

4. In a development apparatus for developing latent electrostatic images borne by a belt-shaped flexible recording medium to visible or transferable images by a rotatable development roller which carries toner thereon and supplies the toner to said recording medium for developing the latent electrostatic images, the improvement wherein said development roller comprises a non-magnetic, cylindrical sleeve which is covered with an electroconductive layer, a magnetic roller disposed within said non-magnetic cylindrical sleeve, said non-magnetic, cylindrical sleeve and said magnetic roller capable of being driven in rotation relative to the other, said toner carried on said development roller is regulated to a predetermined thickness by a doctor blade and said belt-shaped flexible recording medium is in arc-contact with said development roller, said doctor blade is in light contact with the surface of said electroconductive layer, a bias voltage is applied to said non-magnetic cylindrical sleeve or to said electroconductive layer, and another bias voltage is applied between said doctor blade and said nonmagnetic cylindrical sleeve or said electroconductive rubber layer.

5. In a development apparatus for developing latent electrostatic images borne by a belt-shaped flexible recording medium to visible or transferable images by a rotatable development roller which carries toner thereon and supplies the toner to said recording medium for developing the latent electrostatic images, the improvement wherein said development roller comprises a non-magnetic cylindrical sleeve which is covered with an electroconductive layer, said toner carried on said development roller is regulated to a predetermined thickness by a doctor blade, said belt-shaped flexible recording medium is in arc-contact with said development roller, said doctor blade is in light contact with the surface of said electroconductive layer, a bias voltage is applied to said non-magnetic cylindrical sleeve or to said electroconductive layer, and another bias voltage is applied between said doctor blade and said non-magnetic cylindrical sleeve or said electroconductive rubber layer, with the polarities of said two bias voltages being the same as the polarity of the electric portential of the background of said recording medium.

6. In a development apparatus for developing latent electrostatic images borne by a belt-shaped flexible recording medium to visible or transferable images by a rotatable development roller which carries toner thereon and supplies the toner to said recording medium for developing the latent electrostatic images, the improvement wherein said development roller comprises a non-magnetic, cylindrical sleeve which is covered with an electroconductive layer, a magnetic roller disposed within said non-magnetic cylindrical sleeve, said non-magnetic, cylindrical sleeve and said magnetic roller capable of being driven in rotation relative to the other, said toner carried on said development roller is regulated to a predetermined thickness by a doctor blade and said belt-shaped flexible recording medium is in arc-contact with said development roller, said doctor blade is in light contact with the surface of said electroconductive layer, a bias voltage is applied to said non-magnetic cylindrical sleeve or to said electroconductive layer, and another bias voltage is applied between said doctor blade and said non-magnetic cylindrical sleeve or said electroconductive rubber layer, with the polarities of said two bias voltages being the same as the polarity of recording medium.

7. In a development apparatus for developing latent electrostatic images borne by a belt-shaped flexible recording medium to visible or transferable images by a rotatable development roller which carries toner thereon and supplies the toner to said recording medium for developing the latent electrostatic images, the improvement wherein said development roller comprises a non-magnetic cylindrical sleeve which is covered with an electroconductive layer, said electroconductive layer comprising a rubber with a specific resistivity ranging from $10^3$ ohm·cm to $10^8$ ohm·cm and with a thickness ranging from 0.5 mm to 5 mm, and said toner carried on said development roller is regulated to a predetermined thickness by a doctor blade and said belt-shaped flexible recording medium is in arc-contact with said development roller.

8. In a development apparatus for developing latent electrostatic images borne by a belt-shaped flexible recording medium to visible or transferable images by a rotatable development roller which carries toner thereon and supplies the toner to said recording medium for developing the latent electrostatic images, the improvement wherein said development roller comprises a non-magnetic, cylindrical sleeve which is covered with an electroconductive layer, a magnetic roller disposed within said non-magnetic cylindrical sleeve, said non-magnetic, cylindrical sleeve and said magnetic roller each capable of being driven in rotation relative to the other, said electroconductive layer comprising a rubber with a specific resistivity ranging from $10^3$ ohm·cm to $10^8$ ohm·cm and with a thickness ranging from 0.5 mm to 5 mm, said toner carried on said development roller is regulated to a predetermined thickness by a doctor blade and said belt-shaped flexible recording medium is in arc-contact with said development roller.

* * * * *